US009104149B2

(12) United States Patent
Nakamura et al.

(10) Patent No.: US 9,104,149 B2
(45) Date of Patent: Aug. 11, 2015

(54) FIXING DEVICE HAVING SECURED MEMBER WITH RADIUS OF CURVATURE AT INSERTION END AND IMAGE FORMING APPARATUS HAVING THE SAME

(71) Applicant: FUJI XEROX CO., LTD., Tokyo (JP)

(72) Inventors: Satoshi Nakamura, Kanagawa (JP); Shogo Kamiya, Kanagawa (JP); Junpei Amano, Kanagawa (JP); Norimasa Fujiwara, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 19 days.

(21) Appl. No.: 13/952,261

(22) Filed: Jul. 26, 2013

(65) Prior Publication Data

US 2014/0286683 A1 Sep. 25, 2014

(30) Foreign Application Priority Data

Mar. 19, 2013 (JP) ..... 2013-056278

(51) Int. Cl.
*G03G 15/20* (2006.01)

(52) U.S. Cl.
CPC .... *G03G 15/2053* (2013.01); *G03G 2215/2022* (2013.01); *G03G 2215/2038* (2013.01)

(58) Field of Classification Search
CPC ..... G03G 15/2053; G03G 2215/2035; G03G 2215/2038
USPC ..... 399/329
See application file for complete search history.

(56) References Cited

U.S. PATENT DOCUMENTS

| | | | | |
|---|---|---|---|---|
| 6,795,678 | B2 * | 9/2004 | Yura et al. | 399/329 |
| 2004/0184851 | A1 * | 9/2004 | Otsuka et al. | 399/329 |
| 2008/0304882 | A1 * | 12/2008 | Shin et al. | 399/329 |

FOREIGN PATENT DOCUMENTS

| | | | |
|---|---|---|---|
| JP | 11-073046 | A | 3/1999 |
| JP | 2004-053618 | A | 2/2004 |
| JP | 2008-064934 | A | 3/2008 |
| JP | 4206788 | B2 | 10/2008 |

* cited by examiner

*Primary Examiner* — David Gray
*Assistant Examiner* — Laura Roth
(74) *Attorney, Agent, or Firm* — Sughrue Mion, PLLC

(57) ABSTRACT

A fixing device includes a belt, a secured member, a support roller, a heating unit, and a pressure roller that is driven to rotate and has an elastic surface layer deformed when pressing the belt against the secured member so as to form a fixing portion. A recording medium that holds an unfixed image passes through the fixing portion. The secured member has a contact portion and an insertion portion having first and second curved surfaces respectively curved toward first and second sides opposite to each other. Conditions $t(1/r_1+1/r_2) \leq 0.130$ and $r_1<r_2$ are satisfied where t denotes a thickness of the belt, $r_1$ denotes a radius of curvature of the second curved surface in mm, and $r_2$ denotes a radius of curvature of the first curved surface in mm.

2 Claims, 11 Drawing Sheets

FIG. 8

<THICKNESS OF FIXING BELT t = 0.25 mm>

| | | RADIUS OF CURVATURE OF INSERTION PORTION $r_1$ (mm) | | | | |
|---|---|---|---|---|---|---|
| | | 2.0 | 4.0 | 8.0 | 15.0 | 30.0 |
| RADIUS OF CURVATURE OF CONTACT PORTION $r_2$ (mm) | 12.5 | SMUDGE: A IMAGE SHIFT: B (0.145) | SMUDGE: A IMAGE SHIFT: A (0.083) | SMUDGE: A IMAGE SHIFT: A (0.051) | SMUDGE: B IMAGE SHIFT: A (0.037) | SMUDGE: B IMAGE SHIFT: A (0.028) |
| | 25.0 | SMUDGE: A IMAGE SHIFT: B (0.135) | SMUDGE: A IMAGE SHIFT: A (0.073) | SMUDGE: A IMAGE SHIFT: A (0.041) | SMUDGE: A IMAGE SHIFT: A (0.027) | SMUDGE: B IMAGE SHIFT: A (0.018) |
| | 50.0 | SMUDGE: A IMAGE SHIFT: A (0.130) | SMUDGE: A IMAGE SHIFT: A (0.068) | SMUDGE: A IMAGE SHIFT: A (0.036) | SMUDGE: A IMAGE SHIFT: A (0.022) | SMUDGE: A IMAGE SHIFT: A (0.013) |
| | 100.0 | SMUDGE: A IMAGE SHIFT: A (0.128) | SMUDGE: A IMAGE SHIFT: A (0.065) | SMUDGE: A IMAGE SHIFT: A (0.034) | SMUDGE: A IMAGE SHIFT: A (0.019) | SMUDGE: A IMAGE SHIFT: A (0.011) |

*VALUES IN PARENTHESES ARE $t(1/r_1+1/r_2)$

<THICKNESS OF FIXING BELT t = 0.50 mm>

| | | RADIUS OF CURVATURE OF INSERTION PORTION $r_1$ (mm) | | | | |
|---|---|---|---|---|---|---|
| | | 2.0 | 4.0 | 8.0 | 15.0 | 30.0 |
| RADIUS OF CURVATURE OF CONTACT PORTION $r_2$ (mm) | 12.5 | SMUDGE: A IMAGE SHIFT: B (0.290) | SMUDGE: A IMAGE SHIFT: B (0.165) | SMUDGE: A IMAGE SHIFT: A (0.103) | SMUDGE: B IMAGE SHIFT: A (0.073) | SMUDGE: B IMAGE SHIFT: A (0.057) |
| | 25.0 | SMUDGE: A IMAGE SHIFT: B (0.270) | SMUDGE: A IMAGE SHIFT: B (0.145) | SMUDGE: A IMAGE SHIFT: A (0.083) | SMUDGE: A IMAGE SHIFT: A (0.053) | SMUDGE: B IMAGE SHIFT: A (0.037) |
| | 50.0 | SMUDGE: A IMAGE SHIFT: B (0.260) | SMUDGE: A IMAGE SHIFT: B (0.135) | SMUDGE: A IMAGE SHIFT: A (0.073) | SMUDGE: A IMAGE SHIFT: A (0.043) | SMUDGE: A IMAGE SHIFT: A (0.027) |
| | 100.0 | SMUDGE: A IMAGE SHIFT: B (0.255) | SMUDGE: A IMAGE SHIFT: A (0.130) | SMUDGE: A IMAGE SHIFT: A (0.068) | SMUDGE: A IMAGE SHIFT: A (0.038) | SMUDGE: A IMAGE SHIFT: A (0.022) |

*VALUES IN PARENTHESES ARE $t(1/r_1+1/r_2)$

FIG. 9

<THICKNESS OF FIXING BELT t = 0.75 mm>

| | | RADIUS OF CURVATURE OF INSERTION PORTION $r_1$ (mm) | | | | |
|---|---|---|---|---|---|---|
| | | 2.0 | 4.0 | 8.0 | 15.0 | 30.0 |
| RADIUS OF CURVATURE OF CONTACT PORTION $r_2$ (mm) | 12.5 | SMUDGE: A<br>IMAGE SHIFT: B<br>(0.435) | SMUDGE: A<br>IMAGE SHIFT: B<br>(0.248) | SMUDGE: A<br>IMAGE SHIFT: B<br>(0.154) | SMUDGE: B<br>IMAGE SHIFT: A<br>(0.110) | SMUDGE: B<br>IMAGE SHIFT: A<br>(0.085) |
| | 25.0 | SMUDGE: A<br>IMAGE SHIFT: B<br>(0.405) | SMUDGE: A<br>IMAGE SHIFT: B<br>(0.218) | SMUDGE: A<br>IMAGE SHIFT: A<br>(0.124) | SMUDGE: A<br>IMAGE SHIFT: A<br>(0.080) | SMUDGE: B<br>IMAGE SHIFT: A<br>(0.055 ) |
| | 50.0 | SMUDGE: A<br>IMAGE SHIFT: B<br>(0.390) | SMUDGE: A<br>IMAGE SHIFT: B<br>(0.203) | SMUDGE: A<br>IMAGE SHIFT: A<br>(0.109) | SMUDGE: A<br>IMAGE SHIFT: A<br>(0.065) | SMUDGE: A<br>IMAGE SHIFT: A<br>(0.040) |
| | 100.0 | SMUDGE: A<br>IMAGE SHIFT: B<br>(0.383) | SMUDGE: A<br>IMAGE SHIFT: B<br>(0.195) | SMUDGE: A<br>IMAGE SHIFT: A<br>(0.101) | SMUDGE: A<br>IMAGE SHIFT: A<br>(0.058) | SMUDGE: A<br>IMAGE SHIFT: A<br>(0.033) |

*VALUES IN PARENTHESES ARE $t(1/r_1+1/r_2)$

FIXING DEVICE HAVING SECURED MEMBER WITH RADIUS OF CURVATURE AT INSERTION END AND IMAGE FORMING APPARATUS HAVING THE SAME

CROSS-REFERENCE TO RELATED APPLICATIONS

This application is based on and claims priority under 35 USC 119 from Japanese Patent Application No. 2013-056278 filed Mar. 19, 2013.

BACKGROUND

Technical Field

The present invention relates to a fixing device and an image forming apparatus.

SUMMARY

According to an aspect of the present invention, a fixing device includes a belt that has an inner circumferential surface and an endless belt base member that has an outer circumferential surface, on which at least an elastic layer is formed, a secured member that has a contact portion and is secured such that the secured member is in contact with the inner circumferential surface of the belt, a support roller that supports the belt such that the belt is rotatable, a heating unit that heats the belt, and a pressure roller that has an elastic surface layer that is elastically deformed when the elastic surface layer presses the belt against the secured member so as to form a fixing portion. A recording medium that holds an unfixed image formed thereon passes through the fixing portion, and the pressure roller is driven to rotate. In the fixing device, the secured member has a contact portion that has an insertion end and an arc-shaped first curved surface curved toward a first side separated from the pressure roller, the contact portion is in contact with the belt and in contact with the pressure roller with the belt nipped therebetween when the fixing portion is formed. In the fixing device, the secured member has an insertion portion adjacent to the insertion end, the recording medium is inserted into the fixing portion from an insertion end side, and the insertion portion has an arc-shaped second curved surface curved toward a second side opposite to the first side. In the fixing device, conditions $t(1/r_1+1/r_2)\leq 0.130$ and $r_1<r_2$ are satisfied where t denotes a thickness of the belt in mm, $r_1$ denotes a radius of curvature of the second curved surface in mm, and $r_2$ denotes a radius of curvature of the first curved surface in mm.

BRIEF DESCRIPTION OF THE DRAWINGS

Exemplary embodiments of the present invention will be described in detail based on the following figures, wherein:

FIG. 8 includes tables illustrating part of results of an evaluation test;

FIG. 9 is a table illustrating the remaining part of the results of the evaluation test;

DETAILED DESCRIPTION

Exemplary embodiments to implement the present invention (hereafter referred to as "exemplary embodiments") will be described below with reference to the drawings.

First Exemplary Embodiment

Figure 1:
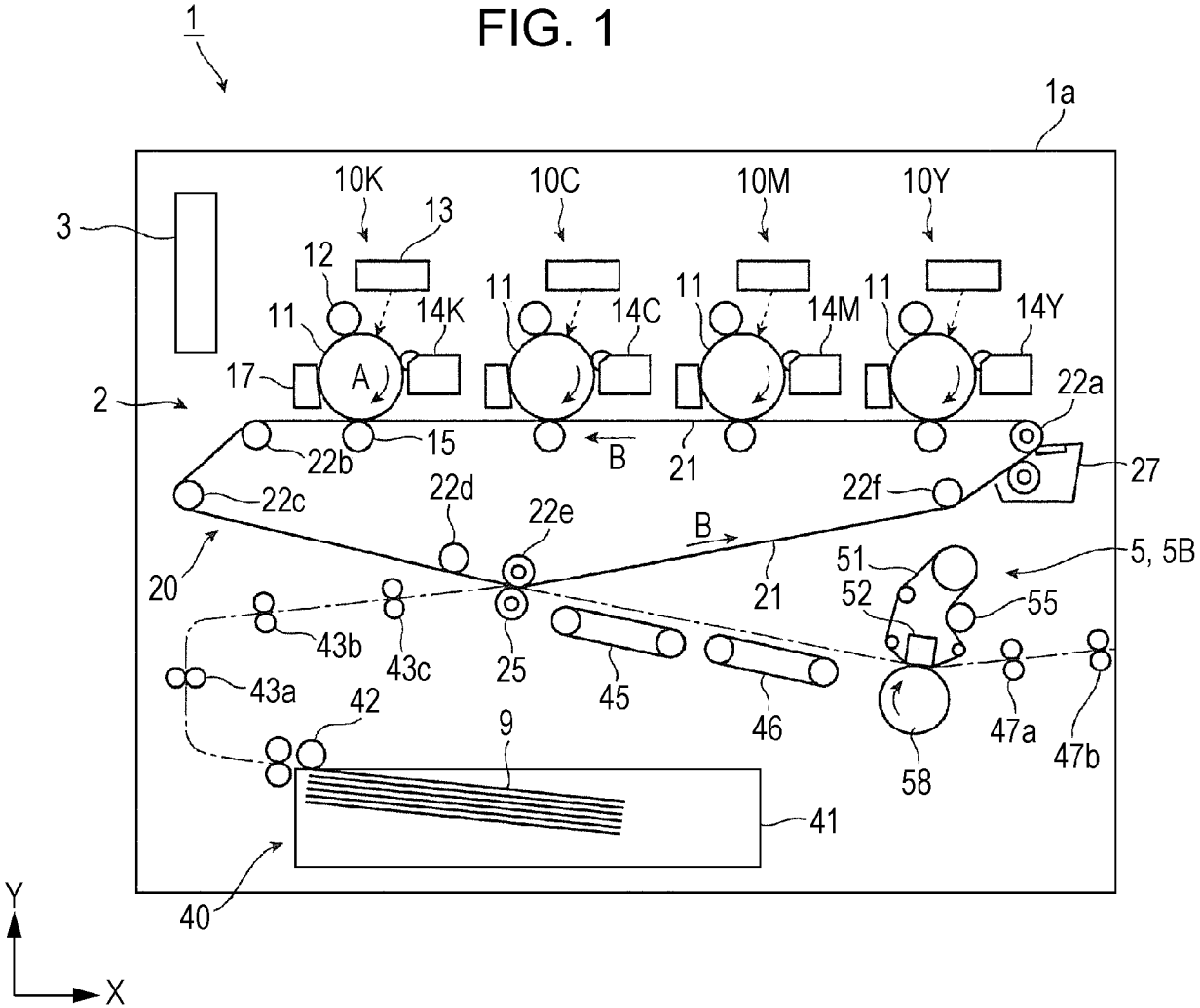
FIG. 1 illustrates an outline of an image forming apparatus in which a fixing device and so forth according to, for example, a first exemplary embodiment are used.
Figure 2:
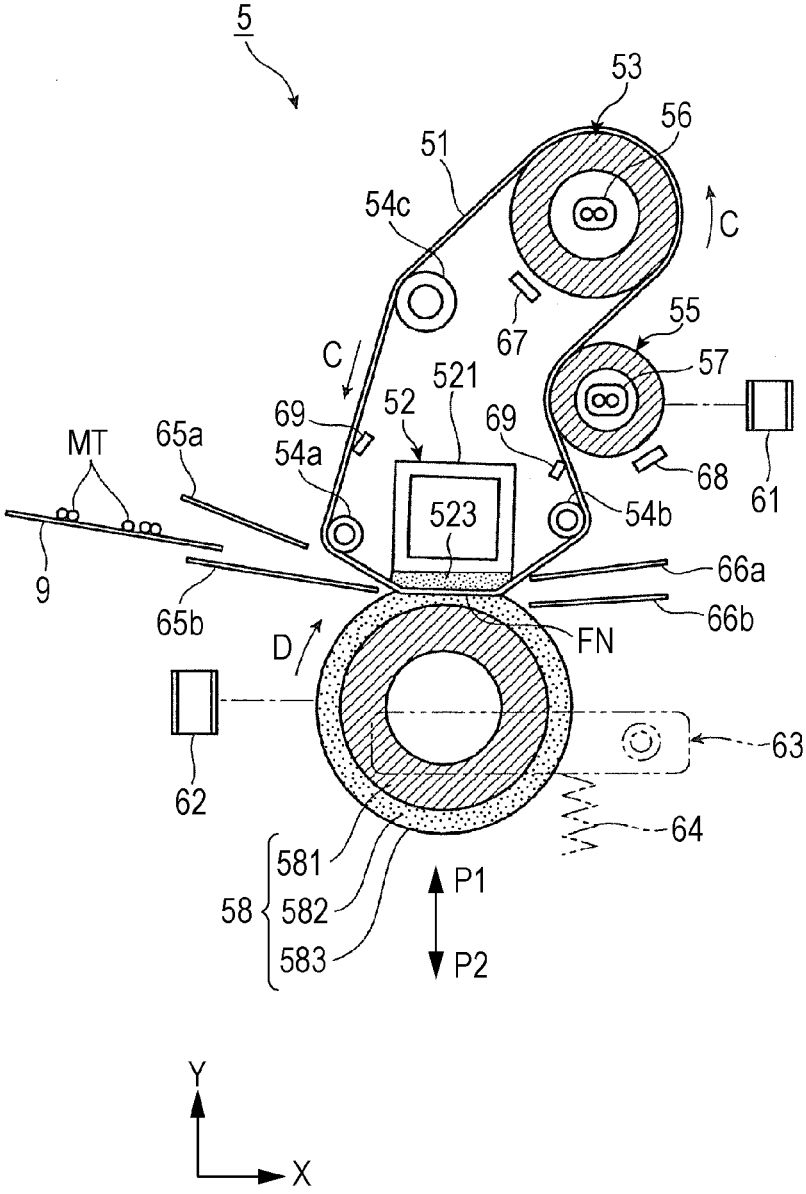
FIG. 2 illustrates an outline of the fixing device of the image forming apparatus illustrated in FIG. 1 seen from the front.
Figure 3:
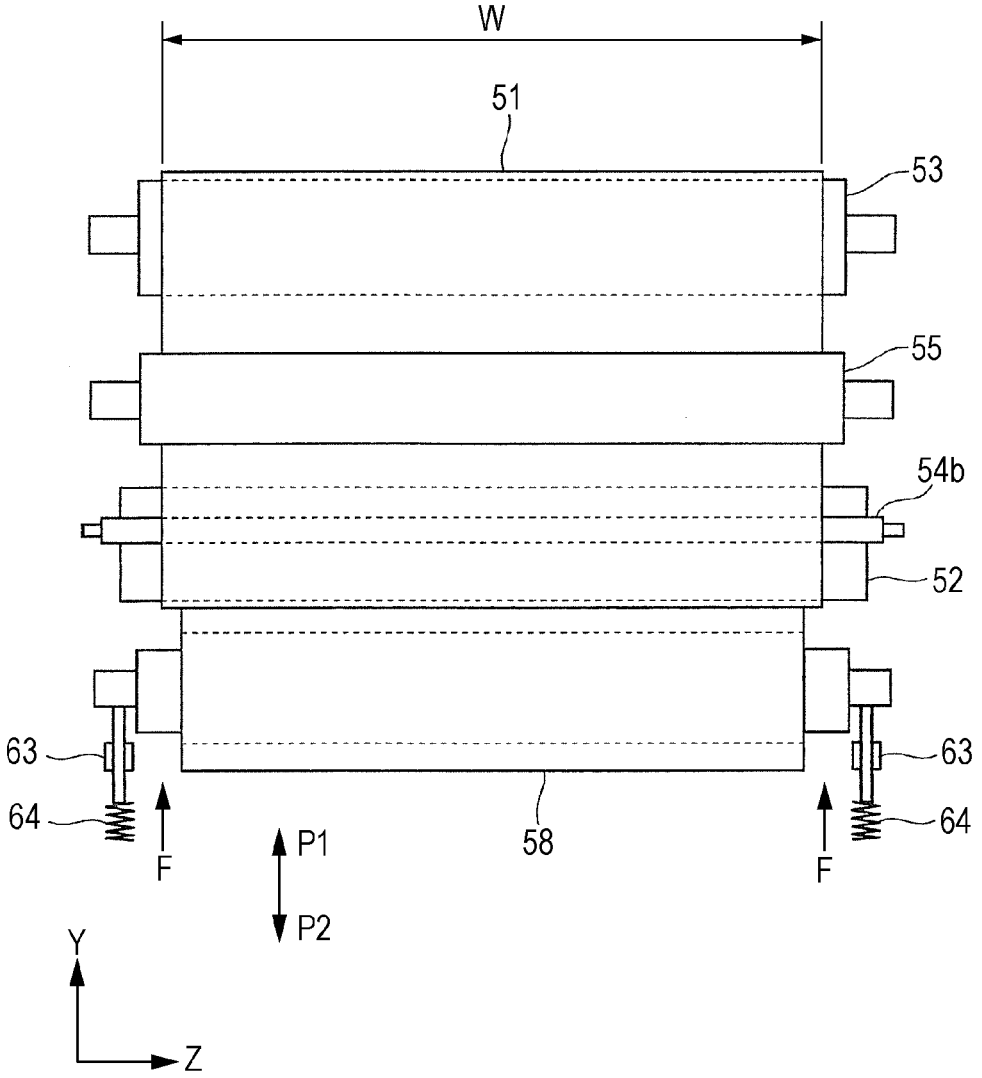
FIG. 3 illustrates an outline of the fixing device illustrated in FIG. 2 seen from a side.

FIGS. 1 to 3 illustrate an image forming apparatus in which a fixing device according to a first exemplary embodiment is used. FIG. 1 illustrates an outline of the entire image forming apparatus, FIG. 2 illustrates an outline of the fixing device of the image forming apparatus seen from the front, and FIG. 3 illustrates an outline of the fixing device seen from a side (sheet exit side).

Structure of Image Forming Apparatus

An image forming apparatus 1 according to a first exemplary embodiment is structured as, for example, a color printer. As illustrated in FIG. 1, the image forming apparatus 1 includes components such as an image forming section 2, a fixing device 5, and a controller 3. The image forming section 2 forms a toner image, which serves as an example of an unfixed image, on a recording sheet 9. The fixing device 5 causes the toner image formed by the image forming section 2 to be fixed onto the recording sheet 9. The controller 3 controls operation of the image forming section 2, the fixing device 5, and so forth. Referring to FIG. 1, reference sign 1*a* denotes a housing of the image forming apparatus 1, and the one-dot chain line indicates a transport path through which the recording sheet 9 is typically transported in the housing 1*a*.

The image forming section 2 includes plural image forming units 10, an intermediate transfer unit 20, and a sheet feeder 40. The image forming units 10 each form a toner image developed with toner included in a developer. The intermediate transfer unit 20 holds the toner image formed by each of the image forming units 10 through first transfer and transports the toner image to a second transfer position where the toner image is finally transferred to the recording sheet 9 through second transfer. The sheet feeder 40 contains and transports the required recording sheet 9 to be supplied to the second transfer position of the intermediate transfer unit 20.

Regarding the image forming units 10, four color toner images, that is, yellow (Y), magenta (M), cyan (C), and black (K) toner images, are respectively formed by the dedicated image forming units 10Y, 10M, 10C, and 10K that utilize an electrophotographic system. Four image forming units 10Y,

10M, 10C, and 10K are, for example, linearly arranged in a substantially horizontal direction and have a substantially common structure as described below except for the difference in the type (color) of the developers used therein.

That is, each of the image forming units 10Y, 10M, 10C, and 10K includes components such as a photoconductor drum 11, a charger 12, an exposure device 13, a corresponding one of developing devices 14Y, 14M, 14C, and 14K, a first transfer device 15, and a drum cleaning device 17. The photoconductor drum 11 is rotated in a direction indicated by an arrow A. The charger 12 causes a circumferential surface (image holding surface) of the photoconductor drum 11 to a required potential. The exposure device 13 irradiates the charged circumferential surface of the photoconductor drum 11 with light in accordance with input information (signal) about an image so as to form an electrostatic latent image. The developing devices 14Y, 14M, 14C, and 14K each form a toner image by developing the electrostatic latent image with the toner of the developer of a corresponding one of the colors (Y, M, C, and K). The first transfer device 15 is implemented, for example, in the form of a roller that transfers the toner image to the intermediate transfer unit 20. The drum cleaning device 17 removes toner and foreign matter that remain on and adhere to the image holding surface of the photoconductor drum 11 so as to clean the photoconductor drum 11 after first transfer has been performed.

The intermediate transfer unit 20 is positioned on the lower side of the image forming units 10Y, 10M, 10C, and 10K. The intermediate transfer unit 20 includes components such as an intermediate transfer belt 21, plural belt support rollers 22*a* to 22*f*, a second transfer device 25, and a belt cleaning device 27. The intermediate transfer belt 21 is rotated in a direction indicated by an arrow B while passing through first transfer positions formed between the photoconductor drums 11 and the first transfer devices 15 (first transfer rollers). The intermediate transfer belt 21 is rotatably supported by the belt support rollers 22*a* to 22*f* from an inner circumferential surface thereof so that the intermediate transfer belt 21 is held in a desired state. The second transfer device 25 is implemented in the form of a roller and causes toner images on the intermediate transfer belt 21 to be transferred onto the recording sheet 9 through second transfer. The belt cleaning device 27 removes toner and foreign matter such as paper dust that remain on and adhere to an outer circumferential surface of the intermediate transfer belt 21 so as to clean the intermediate transfer belt 21 after the intermediate transfer belt 21 has passed the second transfer device 25. Out of the plural belt support rollers 22*a* to 22*f*, the belt support roller 22*a* serves as a drive roller and the belt support roller 22*c* serves as a tension applying roller. The second transfer device 25 presses the intermediate transfer belt 21 against the belt support roller 22*e*, thereby forming a second transfer portion (second transfer position).

The sheet feeder 40 is positioned below the intermediate transfer unit 20 and the second transfer device 25. The sheet feeder 40 includes a single sheet container 41 (or plural sheet containers 41) and a feeding device 42. The sheet container 41 contains the recording sheets 9 of desired size, type, and so forth stacked one on top of another therein. The feeding device 42 feeds the recording sheets 9 one after another from the sheet container 41. A sheet feeding path is provided between the sheet feeder 40 and the second transfer position (a portion where the intermediate transfer belt 21 and the second transfer device 25 are in contact with each other) of the intermediate transfer unit 20. The sheet feeding path has plural sheet transport roller pairs 43*a* to 43*c* and a transport member (not shown). The plural sheet transport roller pairs 43*a* to 43*c* transport the recording sheet 9 fed from the sheet feeder 40 to the second transfer position. The sheet transport roller pair 43*c*, which is positioned immediately in front of the second transfer position, serves as a roller (registration roller) that adjusts timing at which, for example, the recording sheet 9 is transported.

Sheet transport devices 45 and 46 are provided between the second transfer portion of the intermediate transfer unit 20 and the fixing device 5. The sheet transport devices 45 and 46 are each implemented in the form of, for example, a belt and transport the recording sheet 9, which has undergone second transfer and is removed from the intermediate transfer belt 21 for transportation, to the fixing device 5. Furthermore, a sheet ejection path is provided between the fixing device 5 and an ejection opening for the recording sheet 9 formed in the housing 1*a*. The sheet ejection path has sheet ejection roller pairs 47*a* and 47*b* and so forth. The recording sheet 9 that is fed from the fixing device 5 after an image has been fixed onto the recording sheet 9 is ejected to the outside of the housing 1*a* through the sheet ejection path.

Fundamental Operation of Image Forming Apparatus

Next, fundamental image forming operation of the image forming apparatus 1 will be described. Here, as a representative example of image forming operations, an image forming operation is described. In this image forming operation, toner images of four colors (Y, M, C, and K) are combined to form a full-color image by using the above-described four image forming units 10Y, 10M, 10C, and 10K of the image forming section 2.

In the image forming apparatus 1, when the controller 3 receives a request command for image forming operation (print), the photoconductor drum 11 is initially rotated in the arrow A direction in each of the image forming units 10Y, 10M, 10C, and 10K of the image forming section 2. After that, the circumferential surface of each photoconductor drum 11 is charged to a required potential of a required polarity (minus polarity in the first exemplary embodiment) by the charger 12. Next the charged circumferential surface of each photoconductor drum 11 is irradiated with light by using a corresponding one of the exposure devices 13 in accordance with an image signal obtained by converting image information input to the image forming apparatus 1 into a corresponding one of color components (Y, M, C, and K), thereby forming an electrostatic latent image for the color component having a required potential on the circumferential surface of the photoconductor drum 11.

Next, each of the developing devices 14Y, 14M, 14C, and 14K supplies toner of a corresponding one of the colors (Y, M, C, and K), which is charged to a required polarity (minus polarity), through a developing roller or the like to the electrostatic latent image for the color component formed on the photoconductor drum 11. Thus, the electrostatic latent image is developed by electrostatic adhesion of the toner. Through this development, dedicated toner images of four colors (Y, M, C, and K) are formed on the respective photoconductor drums 11.

Next, when the color toner images formed on the photoconductor drums 11 of the respective image forming units 10Y, 10M, 10C, and 10K are transported to the first transfer positions, the first transfer devices 15 cause the color toner images to be transferred onto the outer circumferential surface of the intermediate transfer belt 21 of the intermediate transfer unit 20 rotated in a direction indicated by the arrow B through first transfer such that the toner images are sequentially superposed with one another. Thus, multiple toner images are transferred onto the intermediate transfer belt 21 through first transfer. When first transfer is completed, the drum cleaning device 17 of each image forming unit 10 cleans the circumferential surface of a corresponding one of the photoconductor drum 11 from which the toner image has been transferred through first transfer.

Next, in the intermediate transfer unit 20, the multiple toner images transferred to the intermediate transfer belt 21 through first transfer are held and transported to the second transfer position by rotation of the intermediate transfer belt 21. The sheet feeder 40 feeds the required recording sheet 9 to the sheet feeding path in accordance with the image forming operation. In the sheet feeding path, the sheet transport roller pair 43*c* as the registration rollers supplies the recording sheet 9 by feeding the recording sheet 9 to the second transfer position at a timing adjusted to second transfer.

The second transfer device 25 causes the multiple toner images on the intermediate transfer belt 21 to be collectively transferred onto the recording sheet 9 through second transfer at the second transfer position, thereby forming an unfixed toner image. When second transfer is completed, the belt cleaning device 27 of the intermediate transfer unit 20 cleans the outer circumferential surface of the intermediate transfer belt 21 from which the toner images have been transferred through second transfer.

Next, the recording sheet 9, onto which the toner image has been transferred through second transfer, is removed from the intermediate transfer belt 21 and then transported to the fixing device 5 by the sheet transport devices 45 and 46. In the fixing device 5, the unfixed toner image is fixed onto the recording sheet 9 by performing a required fixing process (applying heat and pressure) as will be described later. At last, in the case where the image is formed only on one side of the recording sheet 9 in the image forming operation, the recording sheet 9 onto which the toner image has been fixed is ejected toward, for example, an ejected sheet container (not shown) disposed outside the housing 1*a* through the sheet ejection path.

By performing the above-described image forming operation, the recording sheet 9, on which a full-color image is formed by combining the four-color toner images is output.

Structure of Fixing Device

Next, the fixing device 5 is described.

As illustrated in FIGS. 2 and 3, the fixing device 5 at least includes an endless fixing belt 51, a secured member 52, inner support rollers 53 and 54*a* to 54*c*, an outer support roller 55, halogen heaters 56 and 57, and a pressure roller 58. The fixing belt 51 serves as a belt member. The secured member 52 is secured so as to be in contact with an inner circumferential surface of the fixing belt 51. The inner support rollers 53 and 54*a* to 54*c* are in contact with the inner circumferential surface of the fixing belt 51 and, together with the secured member 52, support the fixing belt 51 such that the fixing belt 51 is rotatable. The outer support roller 55 is in contact with the outer circumferential surface of the fixing belt 51 and, together with the secured member 52 and the inner support rollers 53 and 54*a* to 54*c*, supports the fixing belt 51 such that the fixing belt 51 is rotatable. The halogen heaters 56 and 57 serve as examples of heating units that heat the fixing belt 51 through the inner support roller 53 and the outer support roller 55, respectively. The pressure roller 58 is presses the fixing belt 51 against the secured member 52 so as to form a fixing process portion FN. The recording sheet 9, on which an unfixed toner image MT has been formed, passes through the fixing process portion FN. The fixing process portion FN is a contact part (nip) formed by part of the fixing belt 51 supported by the secured member 52 and the pressure roller 58 being brought into contact with each other. In this contact part, a process (applying heat and pressure) that fixes the unfixed toner image MT onto the recording sheet 9 is performed.

Figure 4:
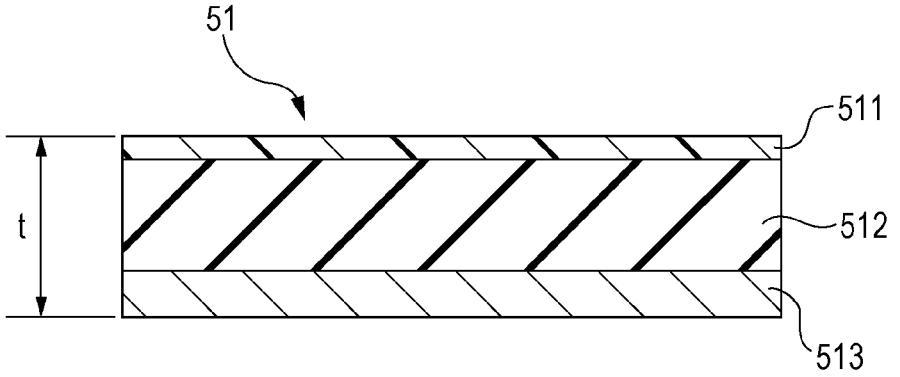
FIG. 4 illustrates a sectional view of a layered structure of a fixing belt of the fixing device illustrated in FIG. 2.

The fixing belt 51 has, for example, as illustrated in FIG. 4, a base member 511 which is an endless belt, an elastic layer 512 formed on a surface (outer circumferential surface) side of the base member 511, and a mold release layer 513 formed on the elastic layer 512. The base member 511 is formed of a material such as polyimide resin, and the thickness thereof is set, for example, in a range from 10 to 100 μm. The elastic layer 512 is formed of an elastic material such as silicone rubber, and the thickness thereof is set, for example, in a range from 100 to 500 μm. The mold release layer 513 is formed of a material such as tetra fluoro ethylene-perfluoro alkylvinyl ether copolymer (PFA), and the thickness thereof is set, for example, in a range from 10 to 100 μm. The entire thickness t of the fixing belt 51 is set, for example, in a range from 0.12 to 0.70 mm. Furthermore, the belt width W (FIG. 3) of the fixing belt 51 is set to a dimension greater than the maximum width of the recording sheet 9 during transportation. The length of the fixing belt 51 is set to a dimension that is required for the fixing belt 51 to be looped over and stretched by the secured member 52 and the plural support rollers 53 to 55.

The secured member 52 includes a support member 521 and a sliding member 523. The support member 521 has a hollow square column shape and is secured. The sliding member 523 is provided on a surface of the support member 521 that is in contact with the inner circumferential surface of the fixing belt 51.

The support member 521 is formed of, for example, iron, aluminum, or another metal material, or a material such as a liquid crystal polymer. The sliding member 523 is formed of, for example, a fluoroplastic such as polytetrafluoroethylene (PTFE) or PFA. A portion of the sliding member 523 that is in contact with the inner circumferential surface of the fixing belt 51 is formed to have a shape that will be described later.

The inner support roller 53 is a cylindrical roller formed of, for example, aluminum, and rotatably disposed so that, among the inner support rollers 53 and 54*a* to 54*c*, the inner support roller 53 is positioned furthest away from the secured member 52. The inner support roller 53 includes the halogen heater 56 that serves as the example of the heating unit in an internal space thereof. Thus, the inner support roller 53 serves as an inner heating roller that heats the fixing belt 51 from the inner circumferential surface side of the fixing belt 51. A temperature detector 67 that detects the surface temperature of the inner support roller 53 is provided for the inner support roller 53. The inner support roller 53 supports the fixing belt 51 such that the inner support roller 53 elastically presses the fixing belt 51 from the inner circumferential surface side toward the outer circumferential surface side. Thus, the inner support roller 53 also serves as a tension applying roller that applies a required tensile force to the fixing belt 51.

The inner support roller 54*a* is an entrance-side holding roller that holds the posture of the fixing belt 51 before the fixing belt 51 is brought into contact with the secured member 52. The inner support roller 54*a* is rotatably disposed at a position close to the secured member 52 on a side of the secured member 52 where contact of the fixing belt 51 with the secured member 52 starts. The inner support roller 54*b* is an exit-side holding roller that holds the posture of the fixing belt 51 after the fixing belt 51 has passed the secured member 52. The inner support roller 54*b* is rotatably disposed at a position close the secured member 52 downstream of the secured member 52 with respect to the rotational direction, which will be described below, of the fixing belt 51. The inner support roller 54*c* is a posture correction roller that corrects the posture of the fixing belt 51 while the fixing belt 51 is being rotated. The inner support roller 54*c* is rotatably disposed between the inner support roller 53 and the inner support roller 54*a*.

The outer support roller 55 is a cylindrical roller formed of aluminum or the like and rotatably disposed between the inner support roller 53 and the inner support roller 54*b* such that the outer support roller 55 is in pressure contact with the outer circumferential surface of the fixing belt 51. The outer support roller 55 includes the halogen heater 57 that serves as the example of the heating unit in an internal space thereof. Thus, the outer support roller 55 serves as an outer heating roller that heats the fixing belt 51 from the outer circumferential surface side of the fixing belt 51. A temperature detector 68 that detects the surface temperature of the outer support roller 55 is provided for the outer support roller 55. Furthermore, the outer support roller 55 is rotated by a first drive device 61, which includes a drive motor or the like, at required timing. Thus, the outer support roller 55 may rotate the fixing belt 51 in a direction indicated by an arrow C through contact with the outer circumferential surface of the fixing belt 51.

The fixing belt 51 is looped over the secured member 52 and the inner support rollers 53 and 54 so as to be supported from the inner circumferential surface side and supported by the outer support roller 55 from the outer circumferential surface side. Thus, the fixing device 5 is rotatable. A required tensile force is applied from the inner support roller 53 serving as the tension applying roller to the fixing belt 51. Thus, the state of the fixing belt 51 in which the fixing belt 51 is stretched by the plural support rollers and the secured member 52 is maintained.

The pressure roller 58 has a cylindrical roller base member 581, an elastic surface layer 582, and a mold release layer 583. The roller base member 581 is formed of aluminum or the like. The elastic surface layer 582 is formed of silicone rubber or the like. The mold release layer 583 is formed of PFA or the like. The elastic surface layer 582 and the mold release layer 583 are sequentially stacked on an outer circumferential surface of the roller base member 581. The elastic surface layer 582 is elastically deformed when the pressure roller 58 presses the fixing belt 51 against the secured member 52 so as to form the fixing process portion FN. Thus, for example, the hardness of the elastic surface layer 582 is set such that the elastic surface layer 582 is softer than the secured member 52. It is sufficient that the length of the pressure roller 58 be greater than the maximum width of the recording sheet 9 during transportation. In the first exemplary embodiment, the length of the pressure roller 58 is set to be slightly smaller than the width W of the fixing belt 51.

Figure 5:
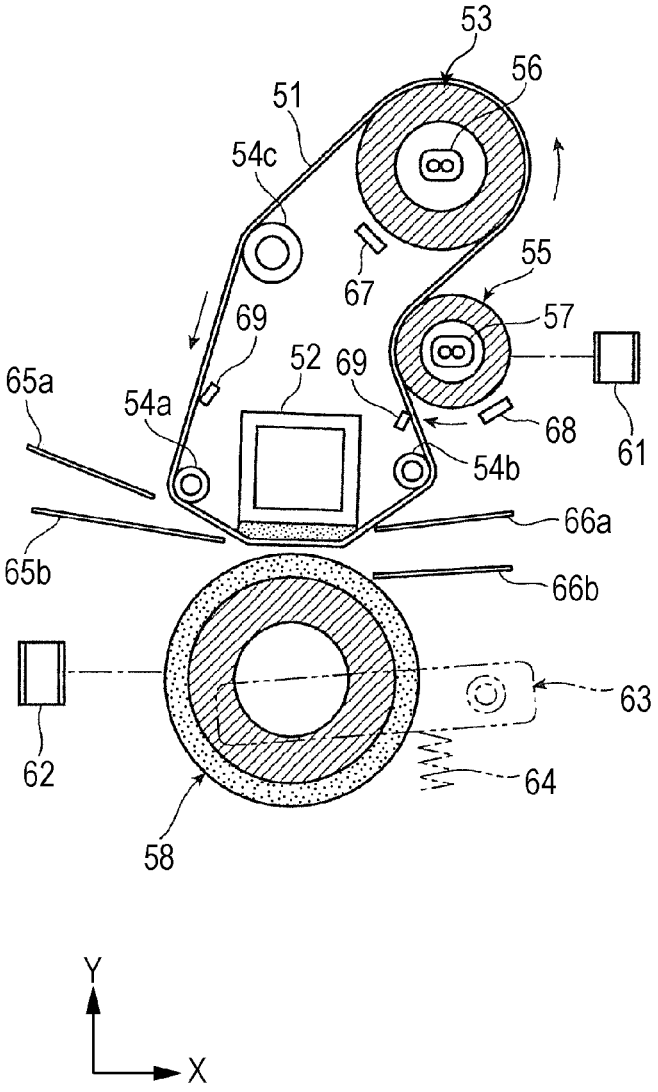
FIG. 5 illustrates a state in which a pressure roller is displaced to a second position in the fixing device illustrated in FIG. 2.

The pressure roller 58 is rotatably supported at a position that opposes the secured member 52 and also supported by a displacement mechanism 63 that displaces the pressure roller 58 to either of the following two positions. The two positions to which the pressure roller 58 is displaced by the displacement mechanism 63 are a first position P1 and a second position P2. As illustrated in FIG. 2, the pressure roller 58 is pressed against the fixing belt 51 so as to form the fixing process portion FN at the first position P1. The pressure roller 58 is, as illustrated in FIG. 5, separated from the fixing belt 51 at the second position P2. In other words, the first position P1 is a pressure contact position where the pressure roller 58 is pressed against the fixing belt 51, which is supported by the secured member 52, and the second position P2 is a separated position where the pressure roller 58 is out of contact from the fixing belt 51.

The following mechanism, for example, is applied to the displacement mechanism 63: that is, the pressure roller 58 is rotatably supported by a support frame that is displaced by a displacement drive unit such as a cam. The pressure roller 58 is displaced to the first position (pressure contact position) P1 at a time when the image forming operation is performed by the image forming section 2 and a fixing operation is performed as one of processes of the image forming operation. However, in principle, the pressure roller 58 is displaced to the second position (separated position) P2 other than the above-described time except for an exceptional case, which will be described later.

Furthermore, a required pressure F toward the secured member 52 is applied by a pressure mechanism 64 to the pressure roller 58 (FIG. 3). The pressure mechanism 64 has a structure that uses a spring member or the like and is combined with the displacement mechanism 63 to function. Furthermore, the pressure roller 58 is rotated by a second drive device 62, which includes a drive motor or the like, at a required time. Thus, when the pressure roller 58 is displaced to the first position P1, by bringing the pressure roller 58 into contact with the outer circumferential surface of the fixing belt 51, which is pressed against the secured member 52, and by rotating the pressure roller 58, the fixing belt 51 may be rotated in a direction indicated by the arrow C.

As illustrated in FIG. 2, the fixing device 5 includes an introduction guide member 65 provided near the fixing process portion FN on a sheet introduction side of the fixing process portion FN. The introduction guide member 65 guides the recording sheet 9 that holds the unfixed toner image MT toward an entrance of the fixing process portion FN. The fixing device 5 also includes an ejection guide member 66 provided near the fixing process portion FN on the ejection side of the fixing process portion FN. The ejection guide member 66 guides the recording sheet 9, onto which the image has been fixed, after the recording sheet 9 has been ejected from an exit of the fixing process portion FN. The ejection guide member 66 includes a lower guide member 66*b* disposed on a side close to the pressure roller 58. The lower guide member 66*b* has a tapered removing tab, which is lightly in contact with the outer circumferential surface of the pressure roller 58. The removing tab removes the recording sheet 9 ejected through the exit of the fixing process portion FN from the outer circumferential surface of the pressure roller 58. The lower guide member 66*b* is attached to a displaceable portion (frame or the like) of the displacement mechanism 63, thereby being displaced in conjunction with displacement operation of the displacement mechanism 63. Furthermore, an applicator 69 is provided on the inner circumferential surface side of the fixing belt 51. The applicator 69 applies lubricant to the inner circumferential surface of the fixing belt 51 so as to reduce frictional resistance caused when the fixing belt 51 is in contact with and passes the secured member 52.

Fundamental Operation of Fixing Device

Next, fundamental operation of the fixing device 5 will be described.

When power of the image forming apparatus 1 is turned on, required power is accordingly supplied to the fixing device 5. Thus, the fixing device 5 starts a warm-up operation.

The warm-up operation of the fixing device 5 is started as follows: as illustrated in FIG. 5, the displacement mechanism 63 is operated so as to displace the pressure roller 58 to the second position P2, where the pressure roller 58 is separated from the fixing belt 51, and maintain a state in which the pressure roller 58 is displaced to the second position P2. In this state, the halogen heaters 56 and 57 are operated so as to heat the inner support roller 53 and the outer support roller 55, thereby indirectly heating the fixing belt 51.

Next, the controller 3 checks the surface temperatures of the inner support roller 53 and the outer support roller 55, which are respectively detected by the temperature detectors 67 and 68, until both the temperatures become equal to or higher than a predetermined preliminary temperature Sx. After it has been confirmed that the surface temperatures become equal to or higher than the preliminary temperature Sx, the displacement mechanism 63 is operated so as to displace the pressure roller 58 to the first position (pressure contact position) P1, and the first and second drive devices 61 and 62 are operated so as to rotated the outer support (heating) roller 55 and the pressure roller 58, respectively.

Thus, the fixing belt 51 having been heated up to the preliminary temperature Sx is pressed against the secured member 52 (see FIG. 2) by the pressure roller 58, and rotational motive forces are transmitted to the fixing belt 51 through rotation of the outer support (heating) roller 55 and the pressure roller 58. Thus, the fixing belt 51 starts to be rotated in the arrow C direction. As a result, the fixing belt 51 is rotated to run over the plural support rollers 53 to 55 and the secured member 52 so as to move around. In addition, when the fixing belt 51 runs over the inner support (heating) roller 53 and the outer support (heating) roller 55, the fixing belt 51 is heated from the outer and inner circumferential surfaces thereof. Thus, the entire circumference of the fixing belt 51 starts to be heated.

After that, the controller 3 checks the surface temperatures of the inner support roller 53 and the outer support roller 55, which are respectively detected by the temperature detectors 67 and 68, until both the temperatures become equal to or higher than a predetermined target temperature Sn. After it has been confirmed that the surface temperatures become equal to or higher than the target temperature Sn, the operation of the fixing device 5 is changed to the fixing operation or the standby operation. At this time, in the case where a printing operation has already been requested during the warm-up operation, the warm-up operation is followed by the fixing operation. Otherwise, the operation of the fixing device 5 is changed to the standby operation.

Thus, the warm-up operation of the fixing device 5 is completed. By performing the above-described warm-up operation, the fixing belt 51 of the fixing device 5 is maintained in a state in which the fixing belt 51 is heated to a temperature at about which at least the fixing operation may be performed. In the case where the printing operation has not been requested during the warm-up operation, for example, the pressure roller 58 may be displaced from the first position (pressure contact position) P1 to the second position (separated position) P2, for example, after a predetermined period of time has passed from when the pressure roller 58 is displaced to the pressure contact position during the warm-up operation.

The fixing device 5 performs the fixing operation, which is a process of the printing operation, when the image forming apparatus 1 (image forming section 2) receives a request for the printing operation.

When the fixing operation is performed, due to a controlling operation of the controller 3, heating operations of the halogen heaters 56 and 57 are subjected to on/off control in accordance with temperatures detected by the temperature detectors 67 and 68. That is, the heating operations of the halogen heaters 56 and 57 are subjected to on/off control (controlled to heat or stop heating) such that the surface temperature of the fixing belt 51 as well as the surface temperatures of the inner support roller 53 the outer support roller 55 are maintained within an allowable range of the fixing temperature.

Next, the control operation performed by the controller 3 causes the displacement mechanism 63 to operate so as to displace the pressure roller 58 from the second position (separated position) P2 to the first position (pressure contact position) P1. The control operation of the controller 3 also causes the second drive device 62 to operate so as to rotate the pressure roller 58. When the fixing operation is performed, the first drive device 61 is not operated and the outer support roller 55 is maintained in a rotatable state.

Figure 6:
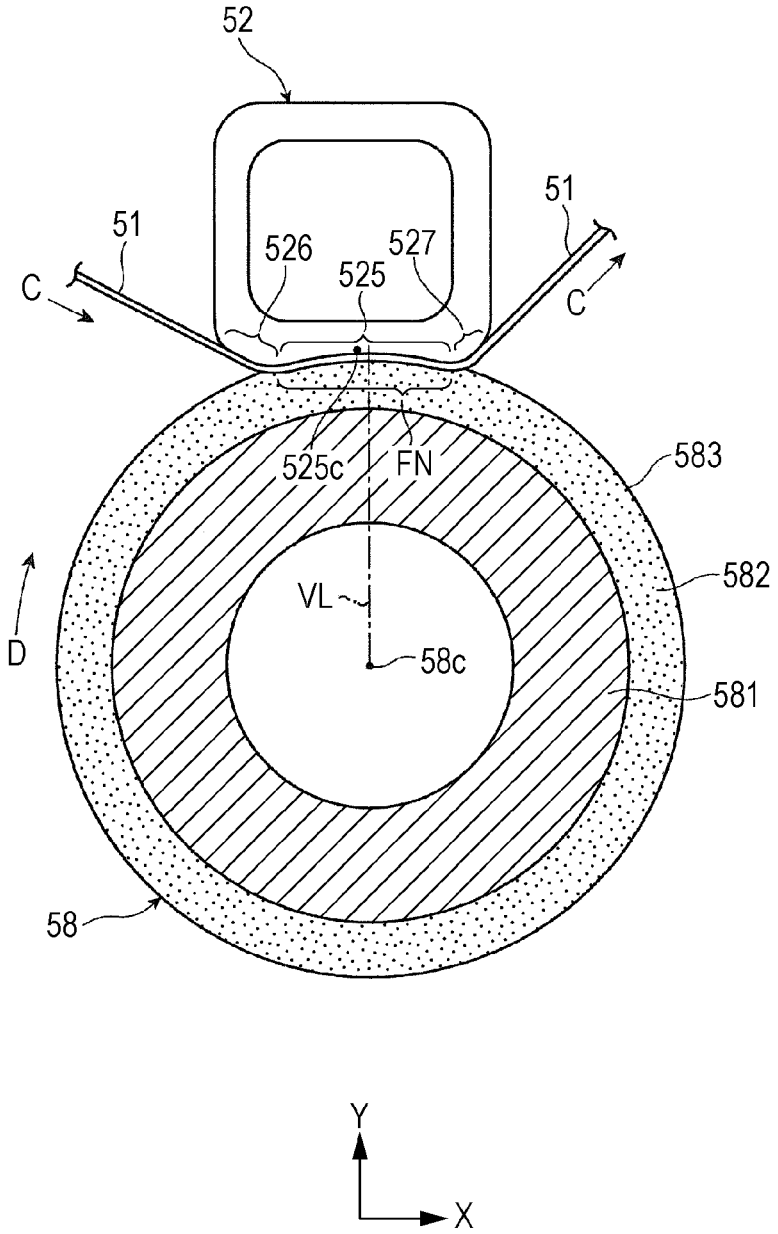
FIG. 6 illustrates an enlarged view of a structure of part of the fixing belt, a secured member, and the pressure roller in the fixing device illustrated in FIG. 2 (in a state in which a fixing process portion is formed)

Thus, in the fixing device 5, as illustrated in FIGS. 2 and 6, the pressure roller 58 presses the fixing belt 51 against the secured member 52 so as to form the fixing process portion FN. In so doing, the elastic surface layer 582 of the pressure roller 58 is elastically deformed such that part of the elastic surface layer 582 that is in contact with and passes the secured member 52 is recessed. Also in the fixing device 5, a rotational motive force is transmitted to the fixing belt 51 from the pressure roller 58, which is in contact with the outer circumferential surface of the fixing belt 51, thereby rotating the fixing belt 51 in the arrow C direction. In so doing, the outer support roller 55 is not driven to rotate. However, the outer support roller 55 is still rotatable and rotated by the rotation of the fixing belt 51. Thus, when the fixing operation is performed, only the rotational motive force from the pressure roller 58 is applied to the fixing belt 51, thereby rotating the fixing belt 51 in the arrow C direction at a required speed.

Next, the controller 3 checks the surface temperatures of the inner support roller 53 and the outer support roller 55, which are respectively detected by the temperature detectors 67 and 68, until both the temperatures become equal to or higher than a temperature Sfmin, which is a lower limit temperature of an allowable range of the predetermined fixing temperature. After it has been confirmed that the surface temperatures become equal to or higher than the lower limit temperature Sfmin of the fixing temperature, the recording sheet 9, on which the unfixed toner image MT has been formed (through second transfer), is introduced into the fixing process portion FN and subjected to the fixing process.

At this time, the recording sheet 9, on which the unfixed toner image MT has been formed (through second transfer), is guided by a lower introduction guide member 65*b* and passes through the contact part, which is the fixing process portion FN, between the fixing belt 51 and the pressure roller 58. The unfixed toner image MT is subjected to a heating and pressurizing process while passing through the fixing process portion FN, and accordingly, the unfixed toner image MT is fixed onto the recording sheet 9. The recording sheet 9 having undergone the fixing process is ejected from the fixing process portion FN. More specifically, the recording sheet 9 is removed from both the fixing belt 51 and the pressure roller 58 immediately after the fixing belt 51 and the pressure roller 58 have passed the fixing process portion FN, and then guided by the ejection guide member 66 so as to be ejected.

Thus, the fixing operation is completed. When the entire fixing operation is completed, the fixing device 5 is changed into a standby state after the displacement mechanism 63 is operated so as to displace the pressure roller 58 from the first position (pressure contact position) P1 to the second position (separated position) P2.

Detailed Structure of Fixing Device

As illustrated in, for example, FIG. 6, the secured member 52 of the fixing device 5 has a contact portion 525. When the fixing process portion FN is formed, The contact portion 525 is in contact with the fixing belt 51 and in contact with the pressure roller 58 with the fixing belt 51 nipped therebetween. The contact portion 525 is formed to have an arc-shaped curved surface curved toward a side separated from the pressure roller 58. In the secured member 52, an insertion portion 526 is formed adjacent to the contact portion 525 on an insertion side, from which the recording sheet 9 is inserted. The insertion portion 526 is formed to have an arc-shaped curved surface curved toward a side opposite to the side toward which the contact portion 525 is curved.

Figure 7:
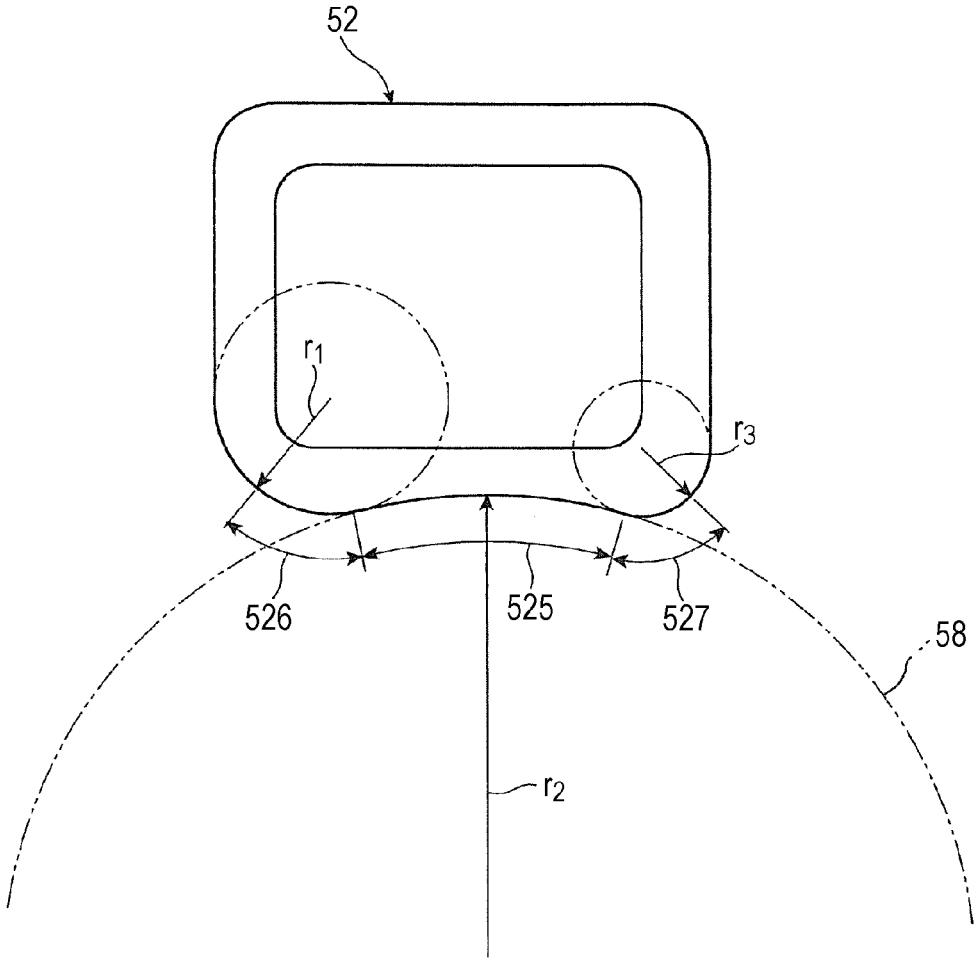
FIG. 7 illustrates a structure of the secured member illustrated in FIG. 6.

Furthermore, referring to, for example, FIGS. 4, 6, and 7, the secured member 52 of the fixing device 5 is formed so as to satisfy the following conditions:

$$t(1/r_1+1/r_2)\leq 0.130 \quad \text{(expression 1), and}$$

$$r_1<r_2 \quad \text{(expression 2)}$$

where t (in mm) denotes the entire thickness of the fixing belt 51, $r_1$ (in mm) denotes the radius of curvature of the curved surface of the insertion portion 526 of the secured member 52, and $r_2$ (in mm) denotes the radius of curvature of the curved surface of the contact portion 525 of the secured member 52.

The above-described two conditional expressions 1 and 2 are generally derived from test results, which will be described later. The former expression 1, the left-hand side of which represents a change in distortion occurring when the fixing belt 51 enters the fixing process portion FN, showing that the value of the left-hand side is equal to or smaller than a certain value. That is, in the expression 1, it is assumed that, in the secured member 52, the curved surface of the insertion portion 526 and the curved surface of the contact portion 525 are in an inverted relationship. When it is assumed that the curvatures added in the left-hand side, the curvatures being the inverses ($1/r_1$ and $1/r_2$) of the radii of curvature $r_1$ and $r_2$ of the curved surfaces, represent a change in the curvature of the fixing belt 51, the entire left-hand side is regarded as equal to a change in distortion of the fixing belt 51 (mostly of the elastic layer 512 and the mold release layer 513) that reaches and passes the contact portion 525 of the secured member 52 from the insertion portion 526 of the secured member 52.

The fixing belt 51 and the secured member 52 of the fixing device 5 have the respective structures as described above. As clearly seen in the test results described later, this may suppress the occurrence of image disturbance immediately before and at a time when the recording sheet 9, on which the unfixed toner image MT has been formed, enters the fixing process portion FN. Thus, fixing may be desirably performed. Furthermore, in the secured member 52 of the fixing device 5, the curved surface of the insertion portion 526 is smoothly continuous with the curved surface of the contact portion 525 while the curvatures (inverts of the radii of curvature) of the curved surfaces are inverted with respect to each other. Thus, when the fixing belt 51 forms the fixing process portion FN, a load (stress) applied to the fixing belt 51 caused when the fixing belt 51 is in contact with and passes the insertion portion 526 and the contact portion 525 of the secured member 52 is reduced. This allows the fixing belt 51 to be smoothly rotated.

Evaluation Test

Evaluation test performed by using the fixing device 5 will be described below.

In the evaluation test, the thickness of the fixing belt 51 and the radii of curvature of the curved surfaces of the insertion portion 526 and the contact portion 525 of the secured member 52 are changed in accordance with the contents illustrated in FIGS. 8 and 9. With the above-described settings, the occurrence of image disturbance is checked as follows: whether or not image disturbance occurs immediately before the recording sheet 9, on which the unfixed toner image MT has been formed, enters the fixing process portion FN (this image disturbance is referred to as "smudge" hereafter); and whether or not image disturbance occurs at a time when the recording sheet 9 enters the fixing process portion FN (this image disturbance is referred to as "image shift" hereafter).

The fixing belt 51 used in the test is formed as follows: the silicone-rubber elastic layer 512 and the 50 μm thick mold release layer 513 formed of PFA are formed in this order on the outer peripheral surface of the base member 511 that uses a 100 μm thick endless-belt formed of polyimide. Regarding the thickness t (in mm) of the fixing belt 51, samples of three different thicknesses, that is, 0.25 mm, 0.50 mm, and 0.75 mm illustrated in tables in FIGS. 8 and 9 are prepared by setting the thickness of the elastic layer 512 to 100 μm, 350 μm, and 550 μm, respectively.

As illustrated in FIGS. 6 and 7, a surface portion of the secured member 52 in contact with the fixing belt 51 has the contact portion 525, the insertion portion 526, and an exit portion 527. The contact portion 525 and the insertion portion 526 have the aforementioned curved surfaces. The exit portion 527 is disposed adjacent to the contact portion 525 on an exit side of the contact portion 525 and formed to have an arc-shaped curved surface curved toward a side opposite to the side toward which the contact portion 525 is curved. As illustrated in the tables of the FIGS. 8 and 9, among the samples of the secured member 52, the radius of curvature $r_1$ (in mm) of the curved surface of the insertion portion 526 and the radius of curvature $r_2$ (in mm) of the curved surface of the contact portion 525 are changed and different radii of curvature $r_1$ (in mm) are used in combination with different radii of curvature $r_2$. The above-described radii of curvature $r_1$ and $r_2$ of each secured member 52 are changed as follows: the radius of curvature $r_3$ (in mm) of the curved surface of the exit portion 527 is fixed; the length of the contact portion 525 is adjusted so that an arc portion (dimension in the rotational direction C of the fixing belt 51) of the insertion portion 526 in contact with the fixing belt 51 is about 10 mm; and the entire length of the surface portion in contact with the fixing belt 51 is about 45 mm.

Figure 12:
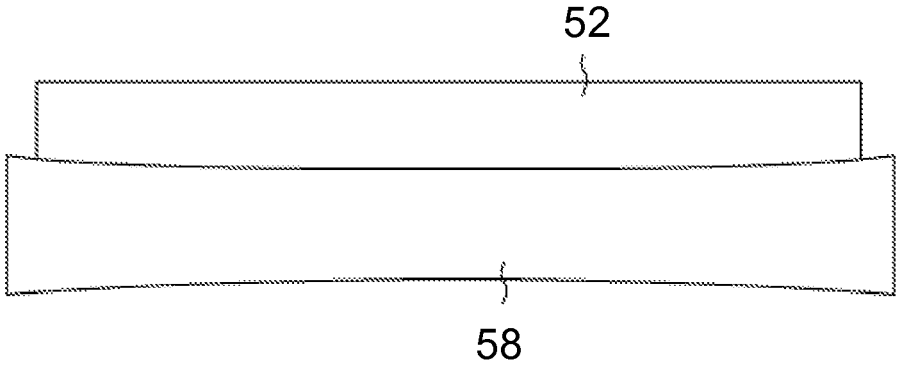
FIG. 12 schematically illustrates a pressure roller and a secured member.

The pressure roller 58 used in the test is formed as follows: the 10 mm thick silicone-rubber elastic surface layer 582 and the 100 μm thick mold release layer 583 formed of PFA are formed in this order on the outer peripheral surface of the 5 mm thick cylindrical roller base member 581 formed of aluminum. The pressure roller 58 has a reverse crown shape, the diameters of both end portions of which are larger than the diameter of its central portion as shown in FIG. 12.

The secured member 52 is set such that the contact portion 525 thereof is in contact with the outer circumferential surface of the pressure roller 58 with the fixing belt 51 nipped therebetween while being substantially parallel to the outer circumferential surface of the pressure roller 58 (substantially parallel to the coordinate axis X). As illustrated in FIG. 6, the secured member 52 is arranged such that an intermediate point 525*c* of the contact portion 525 thereof in the length direction is shifted from the vertical line VL that passes through a rotational center 58*c* of the pressure roller 58 to the upstream side with respect to the rotational direction C of the fixing belt 51. Furthermore, in the secured member 52, when the pressure roller 58 is displaced to the first position P1 so as to form the fixing process portion FN, the elastic surface layer 582 of the pressure roller 58 is elastically deformed as described above. Thus, part of the insertion portion 526 of the secured member 52 located on a side adjacent to the contact portion 525 is brought into contact with the outer circumferential surface of the pressure roller 58 with the fixing belt 51 nipped therebetween.

The fixing operation is performed under the following conditions: the fixing belt 51 is rotated at 300 mm/minutes and heated up to about 180° C., at which fixing may be performed, by the inner support roller 53 and the outer support roller 55. The recording sheet 9 used is the following coated paper: OK topcoat; basic weight is 80 gsm; and manufactured by Oji Paper Co., Ltd.

Regarding smudge, a half-tone test image (image area ratio: about 50%) is formed of black toner K on the entire surface of one side of the recording sheet 9 by using the image forming section 2 of the image forming apparatus 1. When the test image is fixed by the fixing device 5, whether or not image disturbance occurs in part of the fixed test image is visually checked and evaluated in accordance with the following guideline:

A: No disturbance (not visually recognized)

B: Disturbance occurs.

Regarding image shift, toners of the three colors (Y, M, and C) are appropriately blended and a red (R), green (G), or black (B, combined black) colored solid test image (image area ratio: 100%) is formed on the entire surface of one side of the recording sheet 9 by using the image forming section 2 of the image forming apparatus 1. When the test image is fixed by the fixing device 5, whether or not image disturbance occurs in part of the fixed test image is visually checked and evaluated in accordance with the following guideline:

A: No disturbance (not visually recognized)

B: Disturbance occurs.

The results of the above-described evaluations of smudge and image shift are illustrated in FIGS. 8 and 9.

According to the results illustrated in FIGS. 8 and 9, regarding the conditions for the fixing belt 51 and the secured member 52, when a value given by $t(1/r_2+1/r_2)$ is equal to or greater than 0.135, the image shift occurs, and when $r_1>r_2$, smudge occurs.

In addition, it is understood that, in the fixing device 5, regarding the conditions for the fixing belt 51 and the secured member 52, when a value given by $t(1/r_2+1/r_2)$ is equal to or smaller than 0.130 and the relationship $r_1<r_2$ is satisfied, the occurrence of both the smudge and image shift is suppressed.

Alternative Exemplary Embodiment

Figure 10:
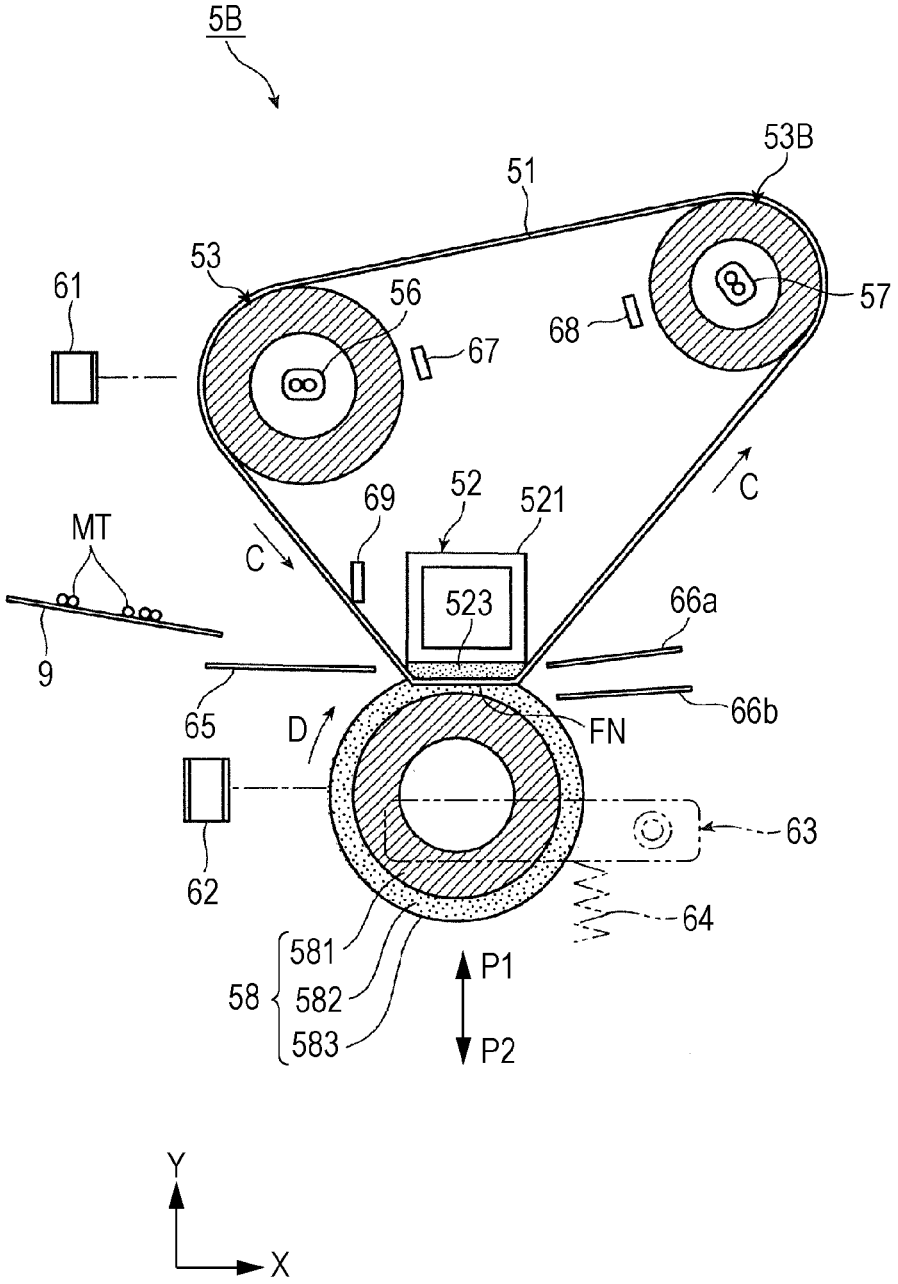
FIG. 10 illustrates an outline of a fixing device according to an alternative exemplary embodiment seen from the front.
Figure 11:
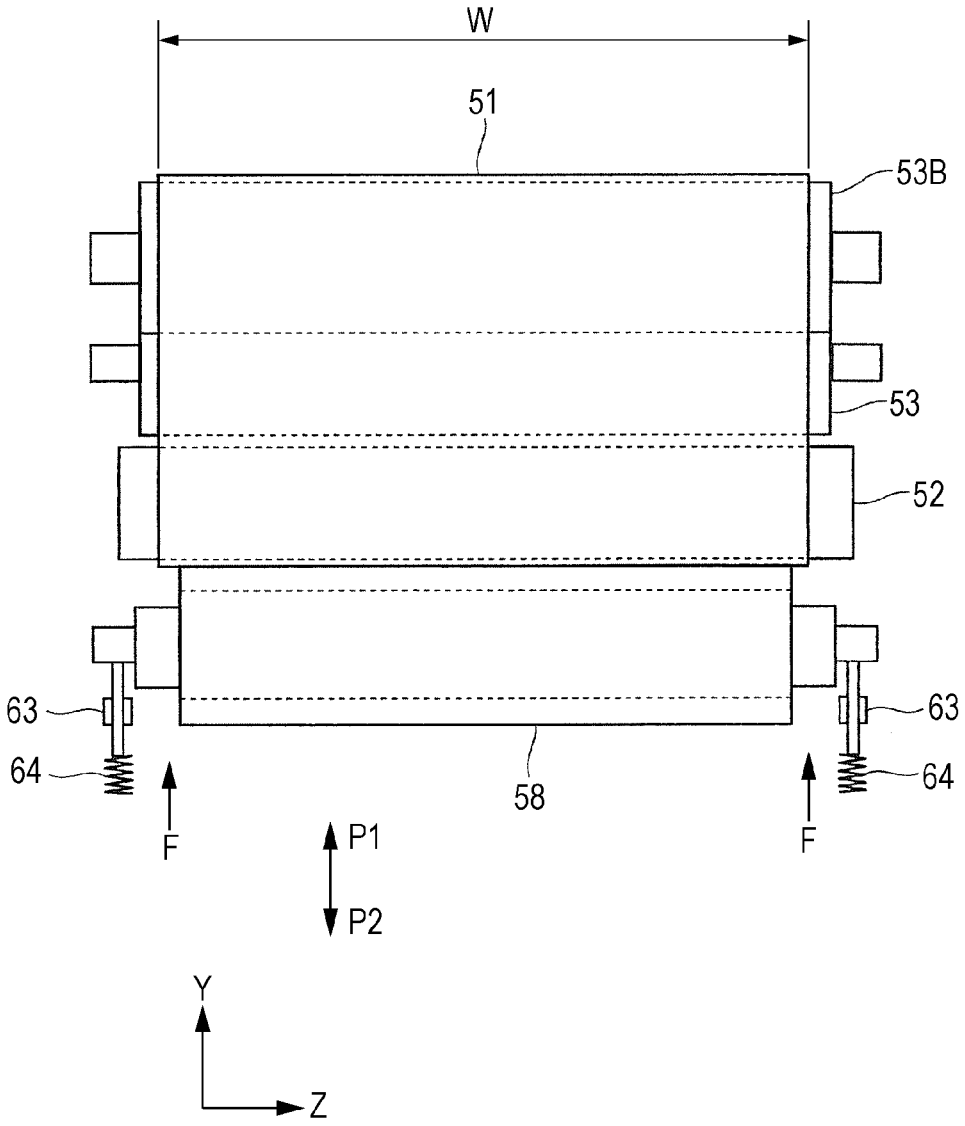
FIG. 11 illustrates an outline of the fixing device illustrated in FIG. 10 seen from a side.

In the first exemplary embodiment, an example of the fixing device 5 is described, to which the outer support roller 55 that heats the fixing belt 51 from its outer circumferential surface is applied. However, the fixing device 5 is not limited to this. For example, a fixing device 5B may be used. As illustrated in FIGS. 10 and 11, The inner support roller 53 and an inner support roller 53B, which heat the fixing belt 51 only from the inner circumferential surface of the fixing belt 51, are applied to the fixing device 5B.

The fixing device 5B at least includes the endless fixing belt 51, the secured member 52, the first and second inner support rollers 53 and 53B, the halogen heaters 56 and 57, the pressure roller 58. The fixing belt 51 serves as the belt member. The secured member 52 is secured so as to be in contact with the inner circumferential surface of the fixing belt 51. The inner support rollers 53 and 53B are in contact with the inner circumferential surface of the fixing belt 51 and, together with the secured member 52, support the fixing belt 51 such that the fixing belt 51 is rotatable. The halogen heaters 56 and 57 serve as examples of the heating units that heat the fixing belt 51 through the inner support rollers 53 and 53B, respectively. The pressure roller 58 is presses the fixing belt 51 against the secured member 52 so as to form the fixing process portion FN, through which the recording sheet 9, onto which the unfixed toner image MT has been formed, passes.

Out of the above-described components of the fixing device 5B, the fixing belt 51, the secured member 52, and the pressure roller 58 have substantially the same structures as those of the fixing belt 51, the secured member 52, and the pressure roller 58 of the fixing device 5 according to the first exemplary embodiment. In these relationships, in FIGS. 10 and 11, the same elements as those of the fixing device 5 according to the first exemplary embodiment are denoted by the same reference signs and the description thereof is omitted except for the case where description is required. In terms of the fixing belt 51, the difference between those in the first exemplary embodiment and the present exemplary embodiment is that the perimeter of the fixing belt 51 is shorter in the present exemplary embodiment than in the first exemplary embodiment.

Out of the inner support rollers 53 and 53B, the inner support roller 53 is a cylindrical roller formed of, for example, aluminum, and rotatably disposed upstream of (with respect to the rotational direction of the fixing belt 51, which will be described below) a portion where the fixing belt 51 is brought into contact with the secured member 52. The inner support roller 53 includes the halogen heater 56 in an internal space thereof. Thus, the inner support roller 53 serves as an inner heating roller that heats the fixing belt 51 from the inner circumferential surface side of the fixing belt 51. The temperature detector 67 that detects the surface temperature of the inner support roller 53 is provided for the inner support roller 53. Furthermore, the inner support roller 53 is connected to a first drive device 61, which includes a drive motor or the like, so as to be rotated. Thus, the inner support roller 53 serves as a drive roller that rotates the fixing belt 51 in the arrow C direction through contact with the outer circumferential surface of the fixing belt 51.

The other inner support roller 53B is a cylindrical roller formed of, for example, aluminum, and rotatably disposed at a specified position downstream of the secured member 52 with respect to the rotational direction of the fixing belt 51. The inner support roller 53B includes the halogen heater 57 in an internal space thereof. Thus, the inner support roller 53B serves as an inner heating roller that heats the fixing belt 51 from the inner circumferential surface side of the fixing belt 51. The inner support roller 53B supports the fixing belt 51 such that the inner support roller 53B elastically presses the fixing belt 51 from the inner circumferential surface side of the fixing belt 51 toward the outer circumferential surface side of the fixing belt 51. Thus, the inner support roller 53B also serves as a tension applying roller that applies a required tensile force.

The fixing belt 51 is looped over the secured member 52 and the inner support rollers 53 and 53B and rotatably supported from the inner circumferential surface side thereof so as to have a substantially inverted triangle shape. A required tensile force is applied from the inner support roller 53B serving as the tension applying roller to the fixing belt 51. This maintains the state of the fixing belt 51 in which the fixing belt 51 is stretched by two inner support rollers 53 and 53B and the secured member 52. Furthermore, fundamental operations (such as the warm-up operation and the fixing operation) of the fixing device 5B are performed in the substantially same manners as those of the fixing device 5 according to the first exemplary embodiment except for, for example, the fixing belt 51 being heated by two inner support rollers 53 and 53B and being rotated by a rotational motive force of the inner support roller 53 during the warm-up operation.

As is the case with the fixing device 5 according to the first exemplary embodiment, the fixing device 5B is structured as follows: in the secured member 52, the contact portion 525 is formed to have the arc-shaped curved surface curved toward the side separated from the pressure roller 58; and also in the secured member 52, the insertion portion 526, from which the recording sheet 9 is inserted, is formed to have the arc-shaped curved surface curved toward the side opposite to the side toward which the contact portion 525 is curved (see FIGS. 6 and 7 for this part of description). Furthermore, the secured member 52 is formed so as to satisfy the following conditions:

$$t(1/r_1+1/r_2)\leq 0.130 \quad \text{(expression 1), and}$$

$$r_1<r_2 \quad \text{(expression 2)}$$

where t (in mm) denotes the entire thickness of the fixing belt 51, $r_1$ (in mm) denotes the radius of curvature of the curved surface of the insertion portion 526 of the secured member 52, and $r_2$ (in mm) denotes the radius of curvature of the curved surface of the contact portion 525 of the secured member 52 (see FIGS. 4, 6, and 7 for this part of description).

The fixing belt 51 and the secured member 52 of the fixing device 5B also have the respective structures as described above. As is the case with the fixing device 5 according to the first exemplary embodiment, this may suppress the occurrence of image disturbance immediately before and at a time when the recording sheet 9, on which the unfixed toner image MT has been formed, enters the fixing process portion FN. Thus, fixing may be desirably performed.

Also in the fixing device 5 according to the first exemplary embodiment and the fixing device 5B described in the example above, the secured member 52 may include a heating unit such as a halogen heater therein. In this case, operation of the heating unit of the secured member 52 may be controlled by providing a temperature detection unit or the like that measures the temperature of a portion of the secured member 52 in contact with the pressure roller 58 with the fixing belt 51 nipped therebetween. The heating unit that heats the fixing belt 51 is not limited to a structure in which the fixing belt 51 is heated through the support rollers that support the fixing belt 51 as exemplified, for example, in the first exemplary embodiment. A dedicated heating unit that has the function of heating only the fixing belt 51 may be adopted.

The image forming apparatus may be an image forming apparatus that forms a monochrome image or an image, the colors and type of which are different from those exemplified in the first exemplary embodiment as long as the image forming apparatus 1, which uses the fixing device 5 or 5B, includes an image forming section that forms an unfixed toner image on a recording medium such as the recording sheet 9.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a belt having an inner circumferential surface and comprising:

an endless belt base member that has an outer circumferential surface and at least an elastic layer being formed on the outer circumferential surface of the belt base member;

a secured member comprising a contact portion and is secured such that the secured member is in contact with the inner circumferential surface of the belt;

a support roller configured to rotatably support the belt;

a heating unit configured to heat the belt; and a pressure roller comprising an elastic surface layer that is elastically deformed when the elastic surface layer presses the belt against the secured member so as to form a fixing portion, a recording medium that holds an unfixed image formed thereon passing through the fixing portion, the pressure roller being driven to rotate;

wherein the contact portion of the secured member comprises an insertion portion provided at an insertion end and a nip contact portion having an arc-shaped first curved surface including a first radius of curvature corresponding to the pressure roller, and the nip contact portion is in contact with the belt and in contact with the pressure roller with the belt nipped therebetween when the fixing portion is formed, wherein the recording medium is inserted into the fixing portion from an insertion end side, and the insertion portion comprising a second radius of curvature curving opposite to the first radius of curvature, wherein conditions $t(1/r_1+1/r_2)\leq 0.130$ and $r_1<r_2$ are satisfied where t denotes a thickness of the belt in mm, $r_1$ denotes the second radius of curvature in mm, and $r_2$ denotes the first radius of curvature in mm, and wherein the pressure roller has a reverse crown shape, diameters of opposite end portions of the pressure roller are larger than a diameter of a central portion of the pressure roller.

2. An image forming apparatus comprising:

an image forming section configured to form an unfixed image on a recording medium; and the fixing device according to claim 1 configured to fix the unfixed image formed by the image forming section onto the recording medium.

* * * * *